United States Patent [19]

Droeser

[11] 4,302,863

[45] Dec. 1, 1981

[54] BRUSH FOR ROTATING BRUSH ROLLERS IN SWEEPING MACHINES

[76] Inventor: Walter Droeser, Ragnaröksgatan 7, S-72355 Västeras, Sweden

[21] Appl. No.: 162,683

[22] Filed: Jun. 25, 1980

[30] Foreign Application Priority Data

Jun. 27, 1979 [SE] Sweden ..... 7905644

[51] Int. Cl.[3] ..... A46B 7/10; A46B 3/16

[52] U.S. Cl. ..... 15/183; 15/198; 15/191 R

[58] Field of Search ..... 15/179, 181, 182, 183, 15/190, 191, 194–199

[56] References Cited

U.S. PATENT DOCUMENTS 2,450,679 10/1948 May ..... 15/183 X 2,721,348 10/1955 Blydenburgh ..... 15/183

FOREIGN PATENT DOCUMENTS 654458 12/1962 Canada ..... 15/183

1057562 5/1959 Fed. Rep. of Germany .

754953 8/1956 United Kingdom ..... 15/183

*Primary Examiner*—Peter Feldman

*Attorney, Agent, or Firm*—Ostrolenk, Faber, Gerb & Soffen

[57] ABSTRACT

Brush bridges with bristle bunches are used in a rotating brush roller in sweeping machines. The bridges can be inserted in axial guides on the brush roller. Each brush bridge comprises two U-shaped sections welded together to form a box section. Openings are made in these sections, and the bristle bunches are inserted and retained in said openings.

4 Claims, 9 Drawing Figures

BRUSH FOR ROTATING BRUSH ROLLERS IN SWEEPING MACHINES

The present invention relates to brushes which are intended for use on brush rollers in sweeping machines. The invention is primarily intended for such machines as are used on airfields to keep runways clean from snow and ice. In such sweeping machines the brushes are subjected to large stresses and heavy wear, requiring the brushes to be changed relatively often. However, the invention can also be used to advantage in sweeping machines used in other places, e.g. streets.

Figure 5:
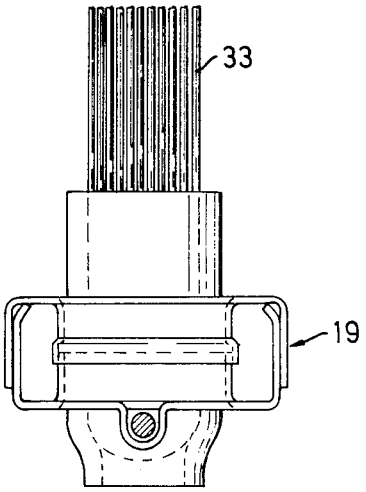

The most usual type of brush roller used at present for snow clearance at airfields is shown in the Swedish Pat. No. 218 161. In practice, this roller has a length of about 4 m and comprises a rotatable cylinder carrying a plurality of removable rings, each of which is provided with a plurality of removable metal wire bristle bunches. Each bunch is taken through a link, bent double round it and kept together by a ring round the bunch. A rubber sleeve is thrust over the link and extends up along a portion of the bunch. The other end of the rubber sleeve depends freely below the link and is drawn down over a pin on the ring. The link is attached to the pin by forcing a nail through the rubber sleeve, link and a hole in the pin, whereafter the nail is secured by being bent, as is shown in FIG. 5 of the patent specification. After a bristle bunch has become worn, it must be dismantled, subsequent to which a new bunch is fitted in the way described above. Since the brush rollers in question have about a hundred rings, each with 16 bristle bunches, 1600 bunches must thus be changed. The number of working hours for dismantling and assembly is in the region of 30 to 40 hours. Apart from this considerable working time and the costs connected thereto, there is the further drawback that the bunches of steel bristles are troublesome to handle manually, which results in that it is easy to get injuries from pricking. Sickness absence due to such injuries can sometimes be rather high.

Another disadvantage is that in certain cases the nail is wrongly fitted so that it comes below or to one side of the link, i.e. it does not extend through the link which holds the bristle bunch, which in turn results in that, when the brush roller is first started, the incorrectly fitted bristle bunch will be thrown off and can thereby cause injury to persons in the vicinity.

A further disadvantage is that if the bristle bunches on one or more rings, e.g. at the middle of the roller, have been damaged and must be exchanged, all the rings lying in front must be removed first, which is a job which is time-consuming and must usually be done in the workshop.

A certain improvement could be obtained by using the device shown in the German Auslegeschrift No. 1 004 588. In this, the bristle bunches are fastened to box-section sheet metal bridges which are in turn clamped in recesses on a plurality of discs along the rotor shaft of the machine. The bridges are disposed axially and around the periphery of the discs at uniform spacing.

The advantage of this device is that the bridges with the bristle bunches can be manufactured as exchangeable units so that when one or more bridges with associated bristle bunches need to be exchanged, this can be done in the field without removing the brush roller from its mountings. The bridges are clamped with clamping pieces which are tightened down by screws and spring rings, however. Dismantling and assembly of the brush bridges therefore require rather time-consuming work. For a brush roller with 16 brush bridges and 5 rotor discs, 120 loose details are required to clamp the bridges down. Apart from the drawback with time-consuming fitting work, the large number of loose details entails a risk that one or some of them can become loose and result in damage or injury when the brush roller is rotated.

In the brush rollers in question, for high-efficiency sweeping of airfields, for example, the rotational speed is often relatively high, with a peripheral speed in the order or magnitude of 40 m per second, the centrifugal forces being thus correspondingly large. For this reason, the known device is less suitable, since the bridges must have a length extending over the whole of that of the brush roller, and usually attaining to about 4 m. The bridges span freely between the rotor discs. The bridge spans can thus be subjected to substantial centrifugal forces and can thereby be permanently bent radially outwards, which in its turn causes the outer ends of the bristle bunches no longer to lie along a uniformly cylindrical surface. The brush roller thus obtains an uneven brush surface, in turn resulting in uneven wear of the bristle bunches.

Another disadvantage with the known device is that openings are made in the box sections of the brush bridges, metal sleeves being inserted and welded in said openings to receive the bristle bunches. 80 sleeves and corresponding welds for them are required for the brush roller in question, which signifies time-consuming manufacturing work. There is furthermore the substantial drawback that the centrifugal forces acting on the bristle bunches will be taken up by the welds retaining the sleeves, since the locking wires engage against the inner ends of the sleeves. This naturally signifies a considerable risk, since the strength of the welded joints is limited. In order to facilitate assembly and dismantling of the brush bridges, the rotor discs can be provided with axial guides at the rotor discs for insertion of the bridges in the manner apparent from the German Auslegeschrift No. 1 057 562, for example. This arrangement still has, however, the drawback of relatively large free spans of the bridges between the rotor discs. This gives rise to a substantial risk that the bridges are permanently bent outwards by the centrifugal forces, which results in an uneven brush surface and also makes difficult or prevents withdrawal of the brush bridges from the axial guides when the bridges are to be changed. The axial guides are furthermore so formed in the known device that there is a risk with large centrifugal forces that the bridges can loosen from the guides with the accompanying hazards of damage to objects and injuries to persons in the vicinity.

Against the background of the prior art, the invention has the object of providing a brush bridge equipped with bristle bunches, which is easy and cheap to manufacture and formed for withstanding the centrifugal forces occurring without the risk of permanent deformation by bending, and is adapted for retaining the bristle bunches in a way having the least possible friction against it and to be easily insertable in, and withdrawable from the axial guides determining the position of the bridges on the brush roller. The invention also intends to provide a brush roller with axial guides which are especially suitable for the brush bridges in accordance with the invention.

This is achieved with a brush bridge and a brush roller having, in accordance with the invention, the characterizing features disclosed in the following patent claims.

The advantages and details distinguishing the invention will now be explained more closely while referring to the attached drawings illustrating an embodiment of a brush bridge in accordance with the invention and a brush roller with axial guides in accordance with the invention.

Figure 1:
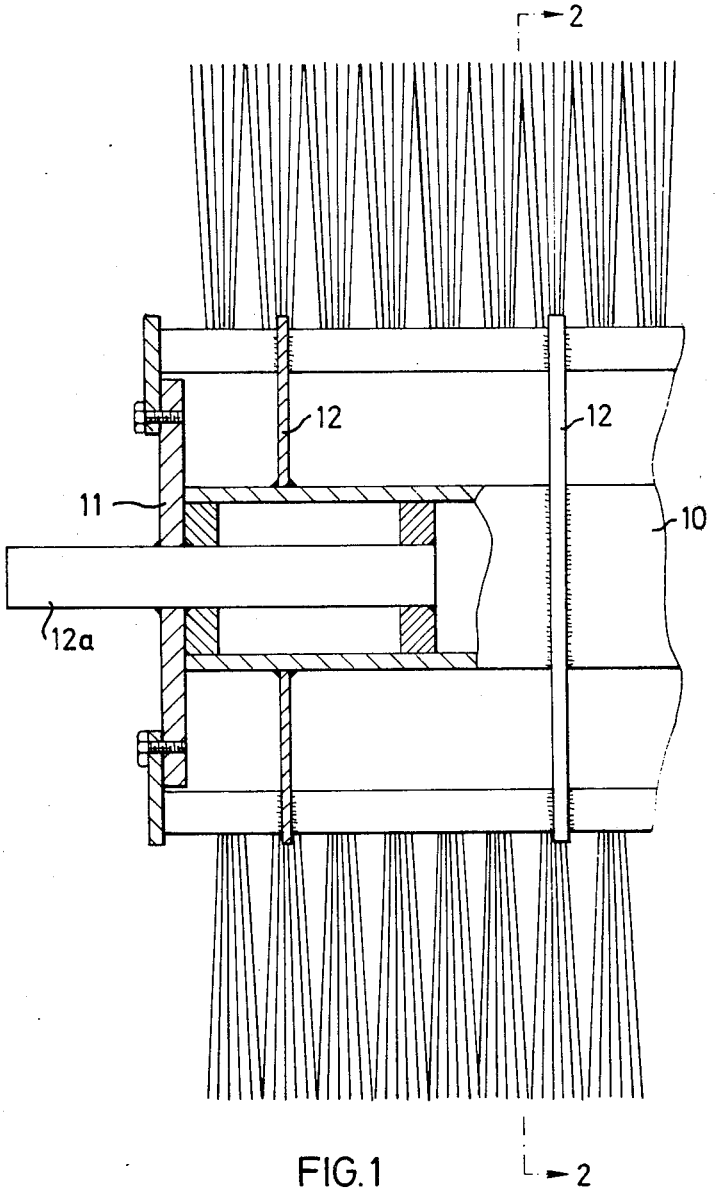
Figure 2:
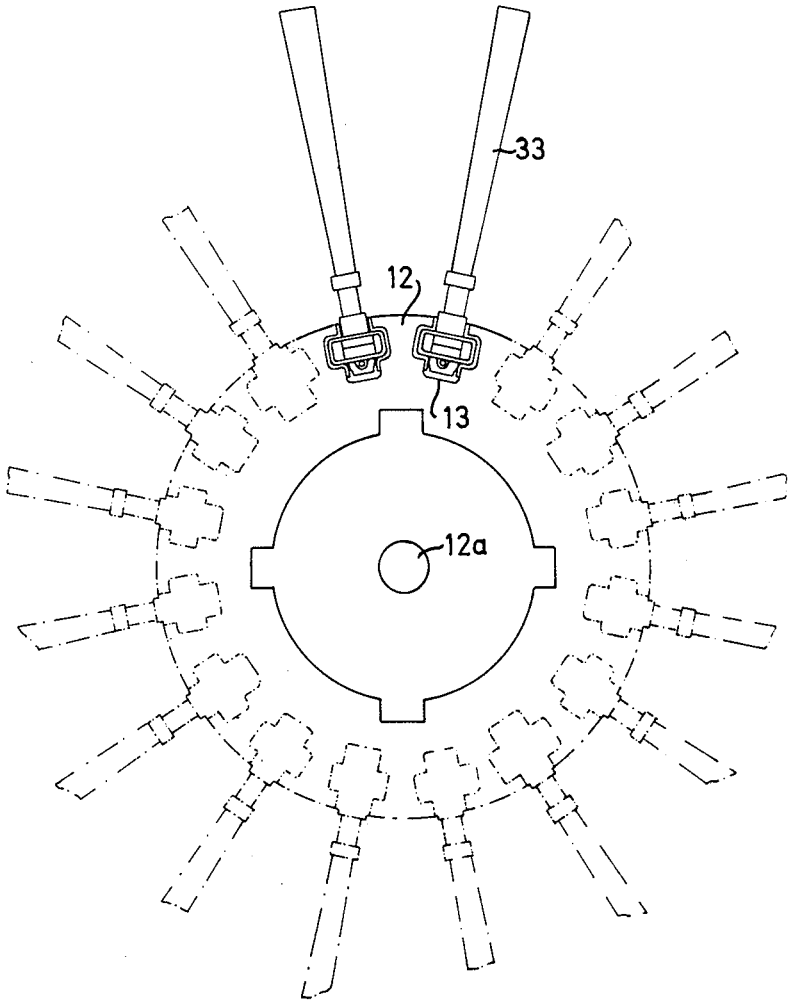
Figure 3:
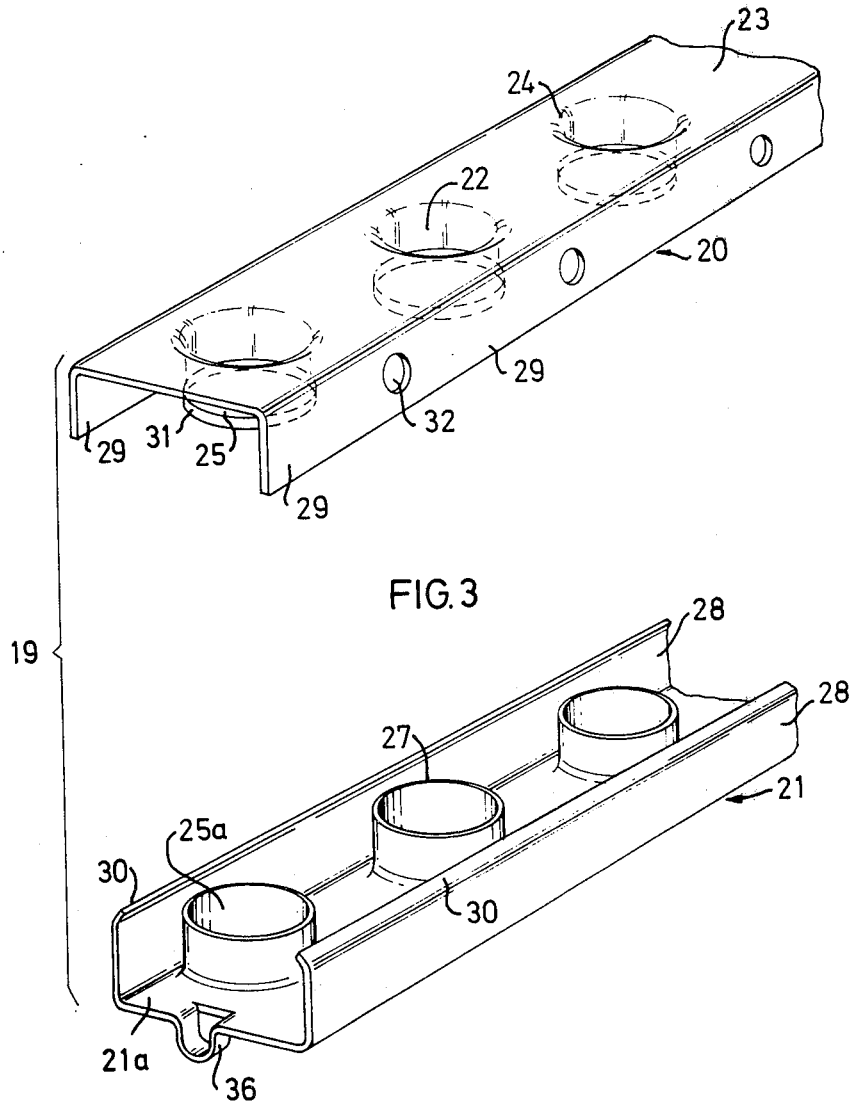
Figure 6:
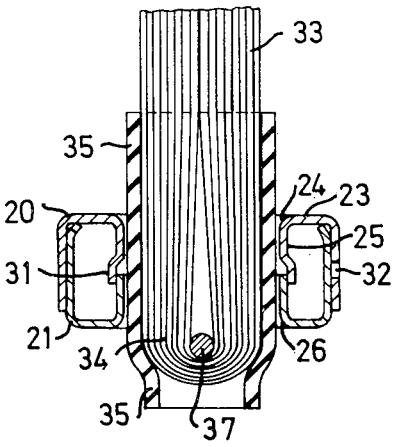
Figure 4:
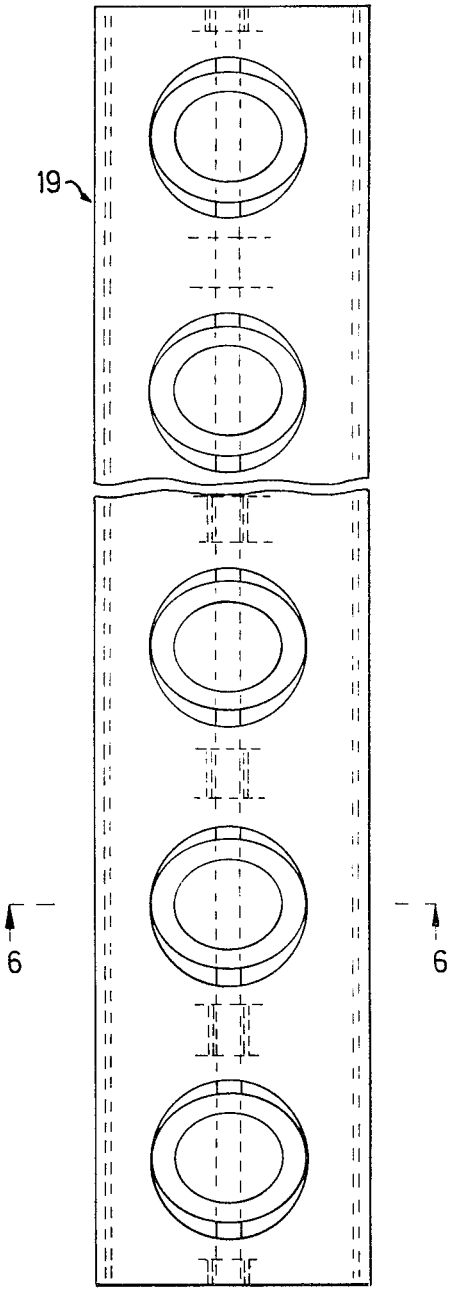
Figure 7:
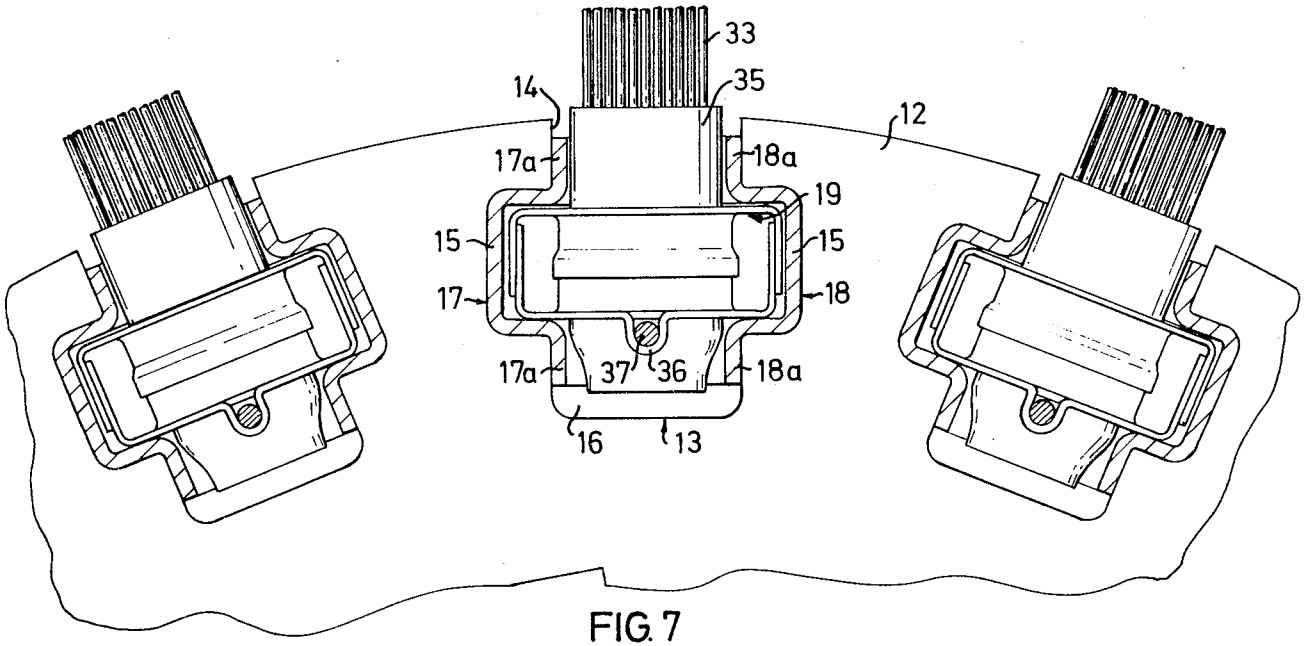
Figure 8:
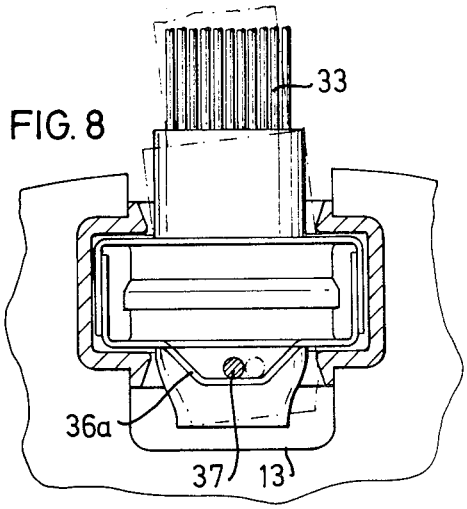
Figure 9:
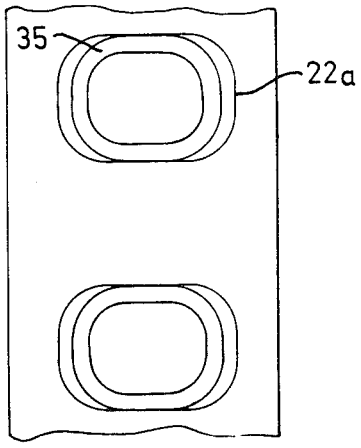

FIG. 1 is a longitudinal section through one end portion of a brush roller with brush bridges in accordance with the invention, FIG. 2 is a cross section along the line 2—2 in FIG. 1, FIG. 3 is a schematic fragmentary perspective view of a pair of U-shaped sections before joining these together into a brush bridge in accordance with the invention, FIG. 4 is a view from above of a brush bridge in accordance with the invention, FIG. 5 is an end view of the brush bridge in FIG. 4 with bristle bunches fitted, FIG. 6 is a cross section along the line 6—6 in FIG. 4, FIG. 7 is an enlarged partial depiction of FIG. 2, FIG. 8 illustrates a modified brush bridge, and FIG. 9 is a partial plan view thereof.

The rotor shaft 10 of the sweeper roller comprises a tube which at the respective end has an end wall 11 with a stud shaft 12*a* for journalling and driving the roller in a manner known per se.

A plurality of discs 12 are welded at spacings along the rotor shaft, each disc having a plurality of uniformly distributed recesses 13 in its edge.

As will be seen from FIG. 7, the respective recess 13 has an opening 14 which changes into two opposing side pockets 15, which then change into a bottom pocket 16.

The recesses 13 in the discs are in register with each other in the longitudinal direction of the roller. In each row of recesses 13 there is fixed an axial guide in the form of a pair of opposing U-shaped members 17,18 forming side runners. Said members have outwardly bent edge flanges 17*a* and 18*a*, respectively. Since the members 17,18 are accommodated in the side pockets 15 of the recess 13, the side and bottom edges of the pockets will grip around the members such as to enable loading said members with relatively large radial forces. The members 17,18 are kept in position in the side pockets by their being welded to the discs 12.

Between each pair of members 17,18 there are inserted a plurality of brush bridges 19 in accordance with the invention in a position one after the other. In practice, the roller sometimes has a length of 4 m, when the length of the bridges in an axial guide is 1 m. An axial guide can thus be filled with 4 brush bridges 19. Having the brush bridges made relatively short, they will be easy to handle in transport and assembly.

To make a brush bridge 19 in accordance with the invention, one starts from two U-shaped members 20,21 according to FIG. 3. The upper member 20 has a plurality of openings 22 in its web 23. The edges of the openings are downwardly stamped to form a softly rounded edge 24, which merges into an inwardly directed stud 25.

In the same way, the lower member 21 is provided with corresponding openings 25*a* in its web 21*a*, rounded-off edges 26 (FIG. 6) and inwardly directed studs 27.

The U-shaped members are somewhat different in size so that the flanges 28 of the lower member 21 can be moved in between the flanges 29 of the upper member 20, and with their edges 30 go into engagement against the web 23 of the upper member. For this purpose the edges 30 of the flanges of the lower member are somewhat inwardly bent.

The studs 25 of the upper member 20 are somewhat opened out 31 so that when the upper member is put together with the lower one, the upper studs 25 will lap over the lower studs 27 thereby locking the two members against mutual displacement, as will be seen from FIG. 6.

There are holes 32 in the flanges of the upper member to facilitate welding the two members together when they have been put together.

Bristle bunches 33 consisting of wires conventionally bent double are inserted in the guides formed by the studs. A rubber sleeve 35, or a sleeve of some other elastic material, is thrust over the doubled end 34, i.e. the end where the bristles are bent double, of the respective bristle bunch.

The doubled end of the bristle bunch with its rubber sleeve is inserted in the respective pair of joined-together studs 25,27 as illustrated in FIG. 6, so that the doubled end will lie below the under side of the brush bridge. A plurality of small loops or eyes 36 are stamped in the web of the lower member 21 to form guides for a conventional locking wire 37. This wire is taken through the eyes 36, the rubber sleeves 35 and the doubled ends 34 of the bristle bunches, as illustrated in FIG. 6. The brush bridge thus formed can now be easily thrust into position on the discs between a pair of U-shaped members or runners 17,18 and locked in position in the latter by stops at the ends.

Manufacture of the two U-shaped members 20,21 according to FIG. 3 can be performed in a relatively cheap manner, and joining the members 20,21 to each other to form a brush bridge 19 is similarly easy to carry out. Fitting the bristle bunches with rubber sleeves and the insertion of the locking wires can also be done without difficulty. The result will be a brush bridge with extremely good strength, especially in respect to bending, since the side walls of the bridge are double due to the flanges of the members 20,21 overlapping each other and being welded to each other. The centrifugal forces on the bristle bunches are taken up by the locking wires 37, which engage against the under side of the stiff brush bridge 19, resulting in secure locking of the bristle bunches. The brush bridge 19 is further reinforced, since it is situated in the two opposing U-shaped members or runners 17,18. Although the plate thickness can be kept relatively low, the structure will be of a stiffness such that no substantial residual bending of the members will be obtained. It will thus be easy to pull out the brush bridges when they are to be exchanged, and to thrust them back again into position between the runners 17,18.

Furthermore, water can freely depart from the radially inward ends of the bristle bunches which, especially during wintertime, prevents the formation of ice from water remaining in the bristle bunches, with consequent imbalance.

FIGS. 8 and 9 illustrate a modification of the brush bridge in which the holes 22*a* are oblong and the eyes 36*a* permit the wire 37 to move to the sides when the brush 33 is tilted to either side. The oblong holes 22*a* will facilitate this tilting and minimize the stress on the brush.

What I claim is:

1. A brush for a rotating brush roller in sweeping machines, especially for airfields and streets, comprising a plurality of bristle bunches attached mutually spaced along a brush bridge intended for mounting in axial guides arranged at the periphery of discs attached to the rotor of the brush roller, said bristle bunches comprising bristle wires bent double round a locking wire or similar means coacting with stops on the brush bridge for retaining the bristle bunches on the bridge, characterized in that the brush bridge is made up from two sheet metal sections each having a substantially U-shaped section with parallel flanges and an intermediate web, that the sections are facing towards each other and are put together so that the flanges of one section lie inside the flanges of the other section and bear against the webs thereof, that openings at uniformly distributed places along the bridge are made in the webs of the two sections, said openings being stamped inwards to form softly rounded edges and merging into cylindrical studs, that the ends of the mutually opposing studs overlap each other, that the two sections are joined together by means of welding, that the bristle bunches are each inserted with their doubled ends in the respective opening in the upper side of the bridge to project out on the under side of the bridge, and that the locking wire on the under side of the bridge is drawn through the doubled ends of the bristle bunches to lock the bunches against withdrawal.

2. A brush bridge as claimed in claim 1, characterized in that a sleeve of elastic material such as rubber is pulled over the doubled end portion of the respective bristle bunch in a conventional manner so that the bunch will engage against the rounded-off edges of the respective opening by the intermediary of said rubber sleeve.

3. A brush roller for brush bridges, particularly in accordance with claim 1 or 2, comprising a plurality of radial discs attached to the rotor shaft of the brush roller and made with recesses in their edges for accommodating a plurality of axial brush bridges, characterized in that for each brush bridge there is arranged an axial guide extending along the entire length of the brush roller and having U-shaped side guides or runners attached to the recesses in the discs such that the recesses partially engage round the runners, and that the mutually opposing runners form a longitudinal cohesive guide for accommodating a brush bridge with rectangular cross section which is insertable between the two runners.

4. A brush roller as claimed in claim 3, characterized in that a plurality of brush bridges have such length that they can be thrust one after the other between a pair of runners for forming together a brush bridge extending over the entire length of the brush roller.

* * * * *